US006283606B1

(12) United States Patent
Wei et al.

(10) Patent No.: US 6,283,606 B1
(45) Date of Patent: Sep. 4, 2001

(54) RATCHET WRENCH WITH ILLUMINATING DEVICE

(76) Inventors: Hung Yin Wei; Ping-Chung Huang, both of P.O. Box 2103, Taichung (TW)

( * ) Notice: Subject to any disclaimer, the term of this patent is extended or adjusted under 35 U.S.C. 154(b) by 0 days.

(21) Appl. No.: 09/495,364

(22) Filed: Feb. 1, 2000

(51) Int. Cl.[7] ..... B25B 23/18
(52) U.S. Cl. ..... 362/119; 362/120; 362/253
(58) Field of Search ..... 362/119, 120, 362/253

(56) References Cited

U.S. PATENT DOCUMENTS

| | | | | |
|---|---|---|---|---|
| 4,253,134 | * | 2/1981 | Barnaly | 362/119 |
| 4,324,158 | * | 4/1982 | Le Roy | 362/119 |
| 5,477,434 | * | 12/1995 | Reed | 362/119 |
| 5,897,198 | * | 4/1999 | Hsieh | 362/119 |
| 6,033,081 | * | 5/2000 | Huang | 362/119 |
| 6,089,729 | * | 7/2000 | Chang | 362/119 |
| 6,106,133 | * | 8/2000 | Lee | 362/119 |
| 6,116,746 | * | 9/2000 | Hsu | 362/119 |
| 6,116,747 | * | 9/2000 | Grawmeyer et al. | 362/119 |
| 6,126,295 | * | 10/2000 | Hillinger | 362/119 |
| 6,135,607 | * | 10/2000 | Cook | 362/119 |
| 6,135,608 | * | 10/2000 | Lin | 362/119 |

* cited by examiner

*Primary Examiner*—Stephen Husar
*Assistant Examiner*—Anabel Ton
(74) *Attorney, Agent, or Firm*—Rosenberg, Klein & Lee

(57) ABSTRACT

A ratchet wrench with illuminating device, including two clamping boards, a pad block, a rotary member and at least one cell cover. By means of the pad block sandwiched between the clamping boards, the ratchet wrench can be easily manufactured and applied to those situations necessitating great torque and working sites with insufficient illumination. Therefore, the ratchet wrench is more competitive on market. When it is necessary to replace the cell, a user only needs to push the cell cover in a specific direction so as to open or close the cell cover. Therefore, the cell can be easily replaced.

8 Claims, 5 Drawing Sheets

RATCHET WRENCH WITH ILLUMINATING DEVICE

BACKGROUND OF THE INVENTION

The present invention relates to a ratchet wrench in which an illuminating device is installed in a pad block of the ratchet wrench to enable a user to work in a working site with insufficient illumination.

FIG. 6 shows a conventional ratchet wrench including two clamping boards 91 and a pad block 92. Two ends of each clamping board 91 are respectively formed with two holes 93. A rotary member 94 is disposed in the hole 93 and then the rotary member 94 and the pad block 92 are clamped and fixed by the clamping boards 91. The rotary member 94 is fitted with a work piece such as a nut (not shown) to tighten or untighten the work piece. In order to properly fit the wrench with the work piece, the pad block 92 must have a certain height.

Such wrench can be easily manufactured and the clamping boards 91 can be made of alloy with sufficient strength. However, such wrench can be hardly used in a working site with insufficient illumination.

SUMMARY OF THE INVENTION

It is therefore a primary object of the present invention to provide a ratchet wrench with illuminating device. By means of the pad block sandwiched between the clamping boards, the ratchet wrench can be easily manufactured and applied to those situations necessitating great torque and working sites with insufficient illumination. Therefore, the ratchet wrench is more competitive on market. When it is necessary to replace the cell, a user only needs to push the cell cover in a specific direction so as to open or close the cell cover. Therefore, the cell can be easily replaced.

The present invention can be best understood through the following description and accompanying drawings wherein:

DETAILED DESCRIPTION OF THE PREFERRED EMBODIMENT

Figure 1:
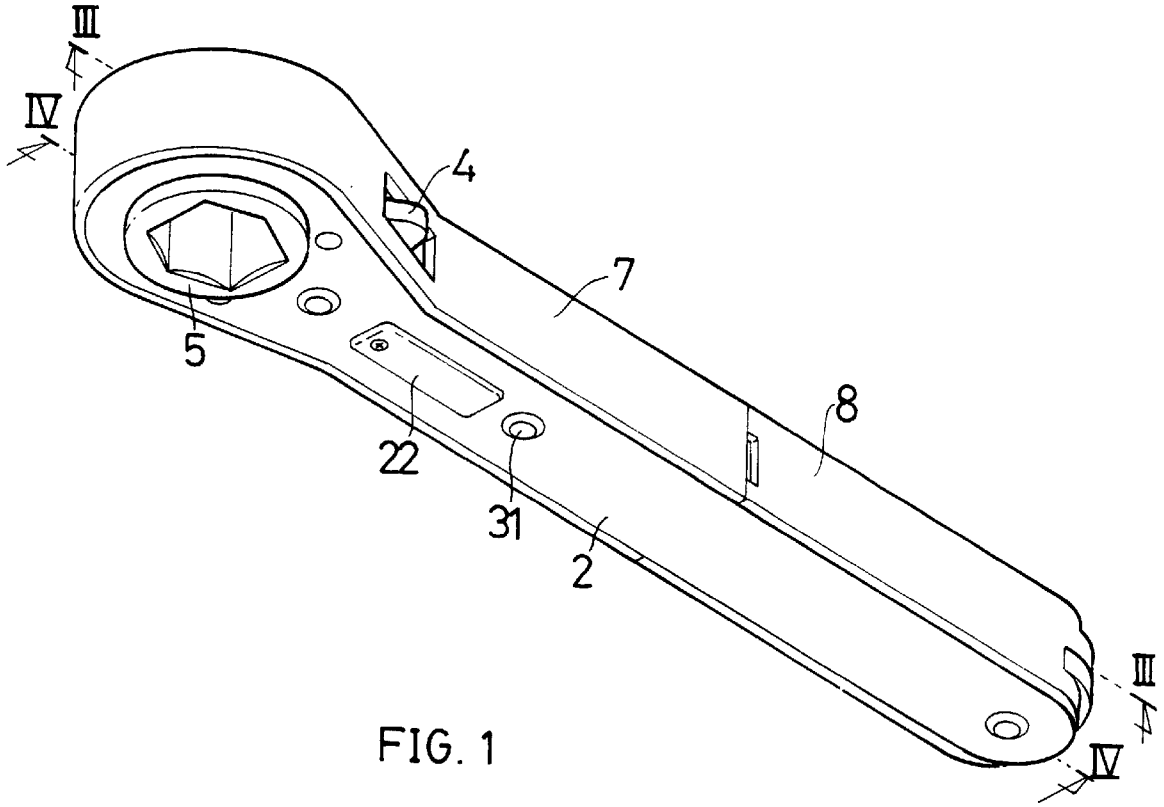
FIG. 1 is a perspective assembled view of the present invention.
Figure 2:
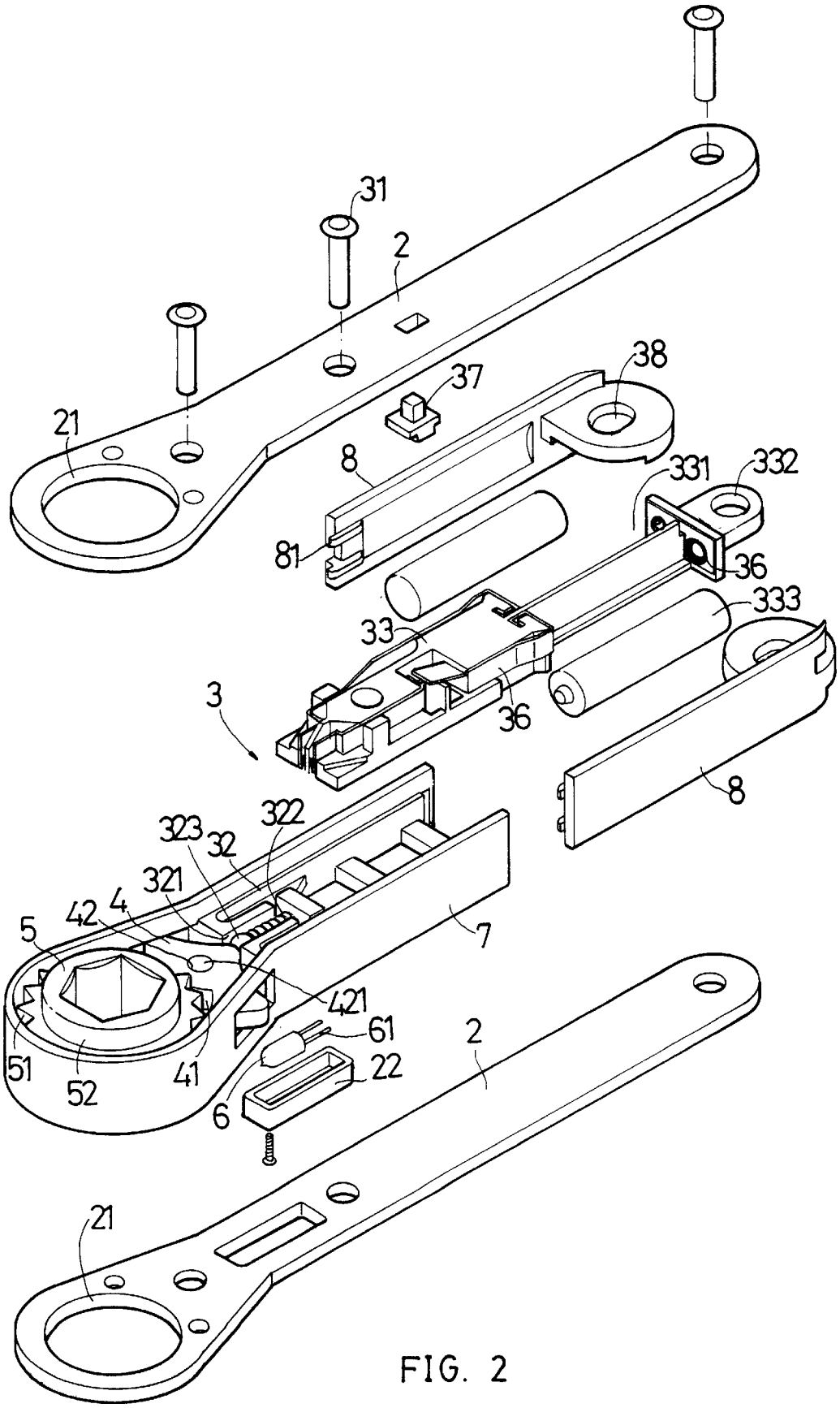
FIG. 2 is a perspective exploded view of the present invention.
Figure 4:
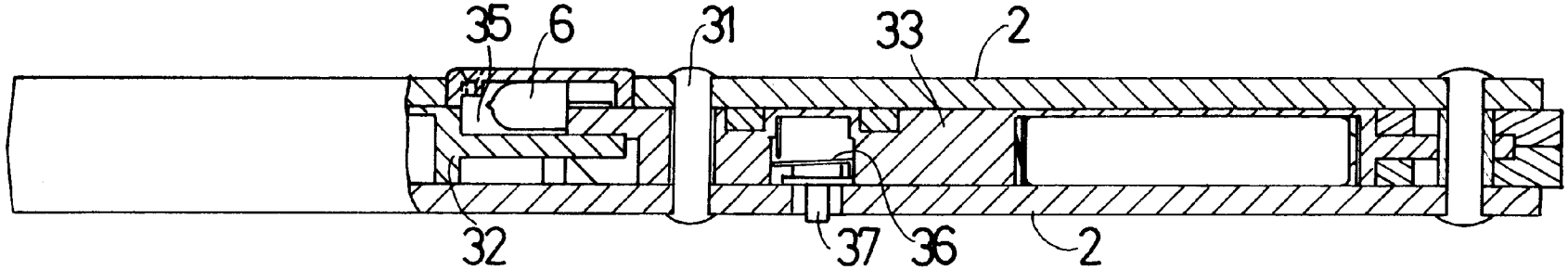
FIG. 4 is a sectional view taken along line IV—IV of FIG. 1.
Figure 3:
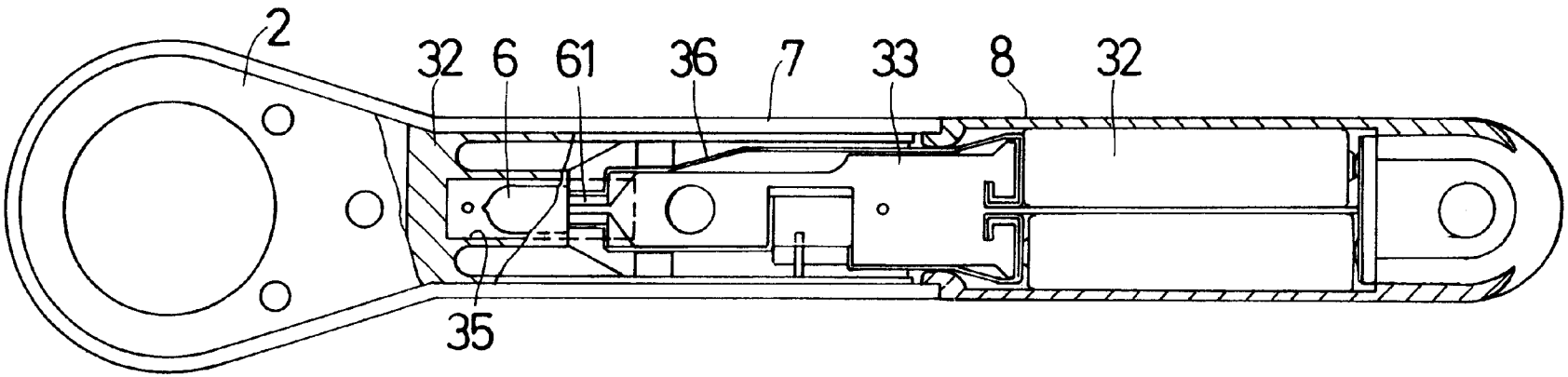
FIG. 3 is a sectional view taken along line III—III of FIG. 1.
Figure 5:
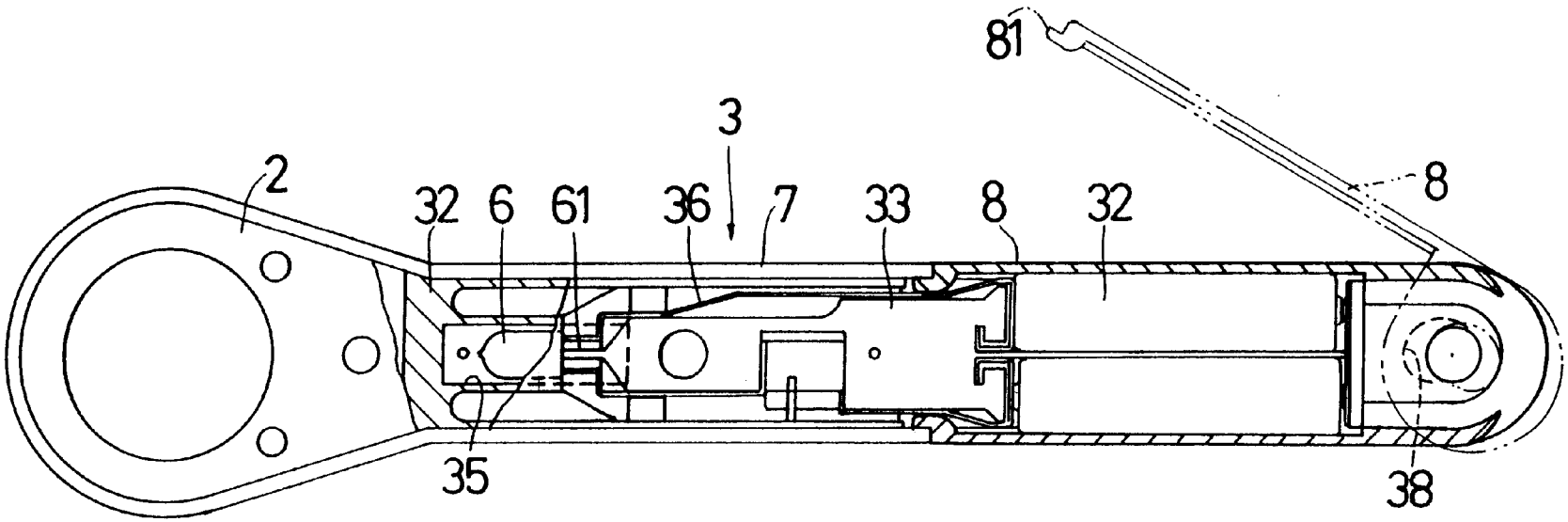
FIG. 5 is a partially sectional view of the present invention, showing that the cell cover is opened.
Figure 6:
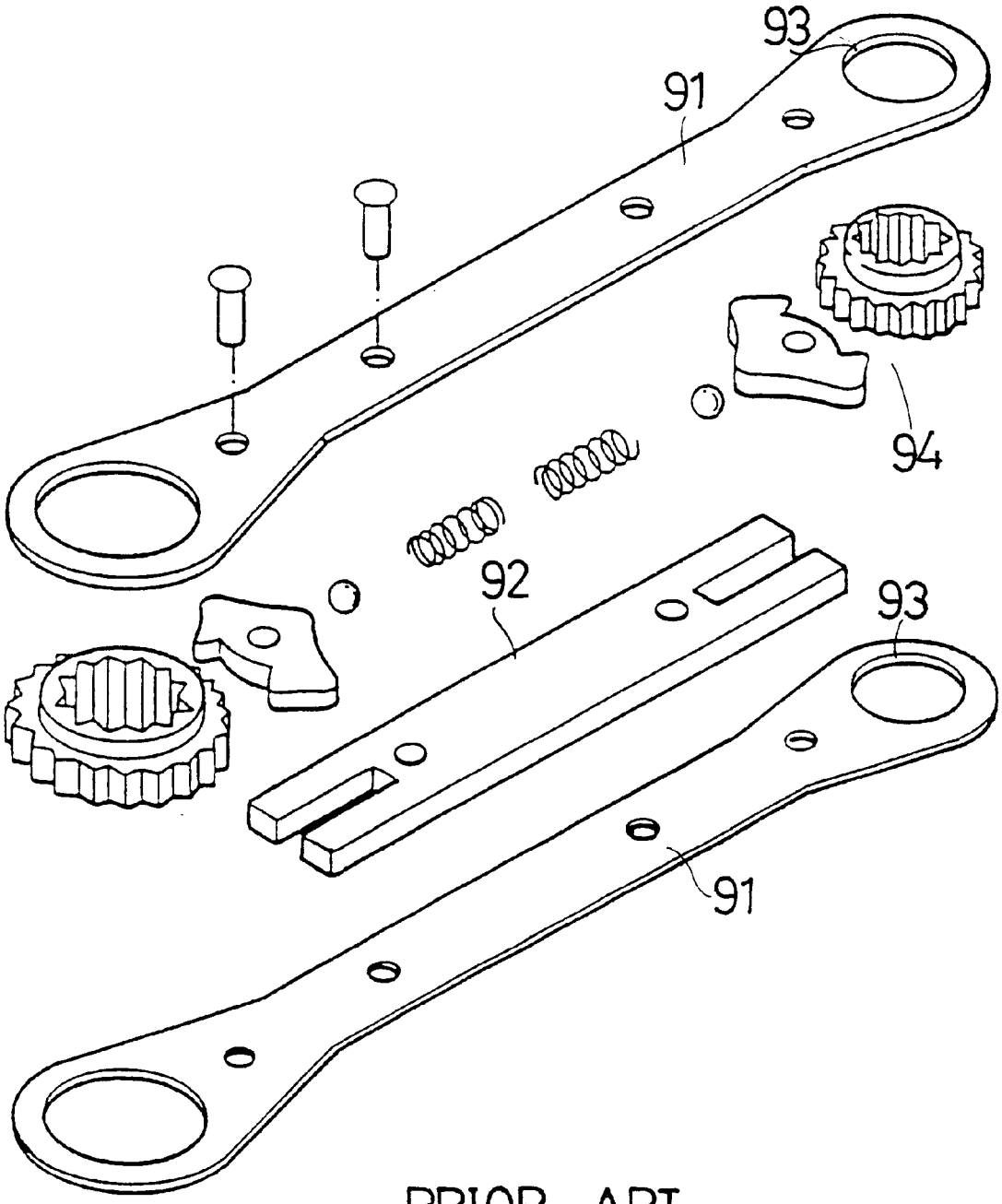
PRIOR ART FIG. 6
FIG. 6 is a perspective exploded view of a conventional ratchet wrench.

Please refer to FIGS. 1 to 5. The wrench of the present invention includes:

two clamping boards 2 respectively formed with two circular holes 21 corresponding to each other;

a pad block 3 sandwiched between the two clamping boards 3, in this embodiment, the pad block 3 being riveted with the clamping boards 2 by multiple rivets 31, the pad block 3 being divided into two parts one of which is a light seat section 32 and the other of which is a cell section 33, the top end of the light seat section 32 being formed with a recess 321 in which a stopper member 323 is disposed and forced by a spring 322 to abut against an engaging member 4, the engaging member 4 having two engaging sections 41 and a hole 42, a pin member 421 being fitted in the hole 42 to pivotally connect the engaging member 4 between the clamping boards 2, one engaging section 41 engaging with a rotary member 5, the rotary member 5 being a cylindrical body having a hexagonal hole, a middle section of outer circumference of the rotary member being formed with a toothed section 51 having multiple teeth, two sides of the rotary member being formed with two fitting sections 52 respectively fitted into the holes 21 of the clamping boards 2 and pivotally connected with the clamping boards 2, whereby the rotary member can be clockwise or counter-clockwise rotated, the light seat section 32 being disposed with a light cavity 35 in which a light emitting member 6 is positioned, the bottom of the light emitting member 6 being disposed with two projecting legs 61, the clamping board 2 being disposed with a transparent cover 22 corresponding to the light cavity 35, a lateral side of the cell section 33 being formed with two cell cavities 331 for receiving cells 333 and a slot 332, the top end and bottom end of the cell cavity 331 being respectively disposed with two conductive plates 36 extending toward the light seat section 32, whereby when the light seat section 32 is connected with the cell section 33, the conductive plates 36 contact with the legs 61 of the light emitting member 6 to turn on the same;

a protective wall 7 disposed along the periphery of the pad block 3;

two cell covers 8 pivotally disposed at the slot 332 of the pad block 3 for sealing the cell cavities 331, the top section of the cell cover 8 being disposed with a lug 81 directed in the same direction as the slot 332, the lug 81 being stopped by the protective wall 7 to close the cell cover 8; and a switch 37 disposed in a hole 38 of the pad block 3 as shown in FIG. 4. The switch 37 by means of electrically connecting with the conductive plate 36 or not controls the on or off of the light emitting member 6.

The switch 37 can electrically connect with the conductive plate 36 or disconnect therefrom. When electrically connected, the circuit is closed and the cell 333 supplies power for the light emitting member 6 to emit light. The light of the light emitting member 6 can pass through the transparent cover 22 of the clamping board 2 to light up the working site of the ratchet wrench.

When assembled, the light emitting member 6 and the conductive plates 36 are placed into the pad block 3 and then the pad block 3 and the rotary member 5 are clamped and fixed by the clamping boards 2. Then the cell cover 8 is pivotally connected at the slot 332 of the pad block 3 and then the protective wall 7 is fitted therewith. The wrench can be easily manufactured and the two clamping boards 2 can be made of alloy with sufficient strength. Therefore, the wrench can be applied to those situations necessitating great torque and working sites with insufficient illumination. The cell cover 8 can be opened or closed only by means of shifting the cell cover 8. For example, when opened, the cell cover 8 is moved toward the side of the slot 332 to make the lug 81 leave the protective wall 7 so as to open the cell cover 8. Reversely, the cell cover 8 can be closed. When it is necessary to replace the cell 333, a user only needs to push the cell cover 8 in a specific direction so as to open or close the cell cover 8. Therefore, the cell 333 can be easily replaced.

According to the above arrangement, the ratchet wrench of the present invention by means of the pad block sandwiched between the clamping boards can be easily manufactured and applied to those situations necessitating great torque and working sites with insufficient illumination. Therefore, the ratchet wrench is more competitive on market.

The above embodiment is only used to illustrate the present invention, not intended to limit the scope thereof. Many modifications of the above embodiment can be made without departing from the spirit of the present invention.

What is claimed is:

1. An illuminating ratchet wrench apparatus comprising:

(a) longitudinally extended upper and lower clamping boards;

(b) a longitudinally extended pad block assembly sandwiched between said upper and lower clamping boards, said pad block assembly including:

(1) a housing section including a first peripheral portion terminating longitudinally at a pair of laterally spaced protective walls, and a second peripheral portion coupled to said first peripheral portion, said second peripheral portion having at least one cell cover coupled to said upper and lower clamping boards to be pivotally displaceable between open and closed positions, said cell cover having formed at a longitudinal end thereof at least one lug member for engaging in said closed position one of said protective walls in releasably locked manner;

(2) a light seat section disposed within said housing section, said light seat section defining a light cavity;

(3) a cell section disposed at least partially within said second peripheral portion of said housing section, said cell section defining at least one cell cavity enclosed by said cell cover when said cell cover is disposed in said closed position thereof, said cell section being coupled in electrically conductive manner to said light seat section;

(c) a ratcheting assembly disposed adjacent said light section in said housing section of said pad block assembly, said ratcheting assembly including an angularly displaceable rotary member selectively locked in angular position relative to said pad block assembly by an engaging member and a spring biased stopper member operatively coupled thereto, said rotary member extending through at least one of said upper and lower clamping boards;

(d) a light emitting member disposed in said light cavity of said light seat section actuable to project light through at least one of said upper and lower clamping boards; and, (e) at least one energy cell disposed within said cell cavity of said cell section for energizing the actuation of said light emitting member.

2. The illuminating ratchet wrench as recited in claim 1 wherein said second portion of said pad block assembly housing section includes a pair of said cell covers one laterally opposing the other in said closed positions thereof, each said cell covers being pivotally displaceable about a common axis.

3. The illuminating ratchet wrench as recited in claim 2 wherein said cell section of said pad block assembly defines a pair of said cell cavities to extend longitudinally along laterally opposed sides thereof.

4. The illuminating ratchet wrench as recited in claim 3 comprising a pair of said energy cells respectively disposed in said cell cavities.

5. The illuminating ratchet wrench as recited in claim 1 wherein said light seat section of said pad block assembly is disposed between said protective walls of said housing section first portion.

6. The illuminating ratchet wrench as recited in claim 6 wherein said ratcheting assembly is disposed in said first portion of said pad block assembly housing section.

7. The illuminating ratchet wrench as recited in claim 1 further comprising a switch coupled to said pad block for selectively actuating said light emitting member.

8. The illuminating ratchet wrench as recited in claim 7 wherein said cell section of said pad block assembly includes a conductive plate extending from said cell cavity to said light seat section, said switch being coupled between said conductive plate and said light emitting member for selectively controlling the energization of said light emitting member.

* * * * *